United States Patent [19]

Andersson

[11] 4,106,696

[45] Aug. 15, 1978

[54] SLEEPER OF STEEL OR SIMILAR MATERIAL

[76] Inventor: Josef Carl-Olof Andersson, Kornettgården, Norberg, Sweden

[21] Appl. No.: 733,889

[22] Filed: Oct. 19, 1976

[51] Int. Cl.[2] ..... E01B 3/16; E01B 9/22

[52] U.S. Cl. ..... 238/62; 238/65; 238/67; 238/69; 238/98; 238/283; 238/350

[58] Field of Search ..... 238/62, 63, 64, 98, 238/283, 350, 59, 60, 61, 65, 66, 67, 68, 69

[56] References Cited

U.S. PATENT DOCUMENTS

| | | | |
|---|---|---|---|
| 445,275 | 1/1891 | Jeffers | 238/63 |
| 466,942 | 1/1892 | Harris | 238/63 |
| 744,285 | 11/1903 | Black | 238/69 |
| 902,312 | 10/1908 | Modlin | 238/350 X |
| 988,947 | 4/1911 | Pfleegor | 238/350 X |
| 994,902 | 6/1911 | Bell | 238/98 X |
| 1,021,661 | 3/1912 | Conklin | 238/69 |
| 1,398,119 | 11/1921 | Taylor et al. | 238/63 X |
| 1,403,027 | 1/1922 | Hanner | 238/62 |
| 1,567,664 | 12/1925 | Martin | 238/64 |

FOREIGN PATENT DOCUMENTS

| | | | |
|---|---|---|---|
| 593,500 | 5/1959 | Italy | 238/62 |

*Primary Examiner*—Randolph A. Reese
*Attorney, Agent, or Firm*—Witherspoon, Lane & Hargest

[57] ABSTRACT

A sleeper for receiving and securing a pair of railway rails has openings for receiving the rails for screw-less mounting. Either one or both flanges of the rail foot is secured in the opening by cooperation with a lug of the sleeper. The lug or lugs may be bendable in order to be open for mounting and closed by bending upon mounting for securing the rail. A supporting plate may be provided on the bottom of the opening and may have a resilient layer applied thereon.

5 Claims, 10 Drawing Figures

14
16
12
10

18c
18d
18b
18a
18
16"
16"i
16'
16
16"u
I
I
10

18'
18'd
18'c
18'b
18'd
16"i
16"
16"u
18'
18'e
16'h
16'
18'a
16'v

18"d
18"
18"d
18"

16
19
14

16
19
18'
18'a
14

20
18
22
X
X
14

16
19'
19'

20
22
12
14

14
20
22
12

SLEEPER OF STEEL OR SIMILAR MATERIAL

The present invention relates to a sleeper of the type defined in the preamble of the main claim.

Previously known sleepers exhibit several grave inconveniences. On the one hand, they are expensive in manufacture if made from wood as only pine wood sleepers can be used and, in addition, only hearty timber has the necessary strength and durability. Finally, the life time of wood sleepers is comparatively short which necessitates exchange of sleepers at short intervals. Mounting costs are also important because the rails have to be attached to the sleepers by screwing.

It is the purpose of the present invention to eliminate these drawbacks and to present a sleeper having lower manufacture costs, considerably increased life length in comparison with known sleepers and low mounting costs excluding the use of any type of screwing tools.

This result is obtained by applying the characteristic features according to the attached claims.

The invention will be explained in detail by reference to the attached drawings showing embodiments of the object of the invention.

Figures 1, 2, 3, 4:
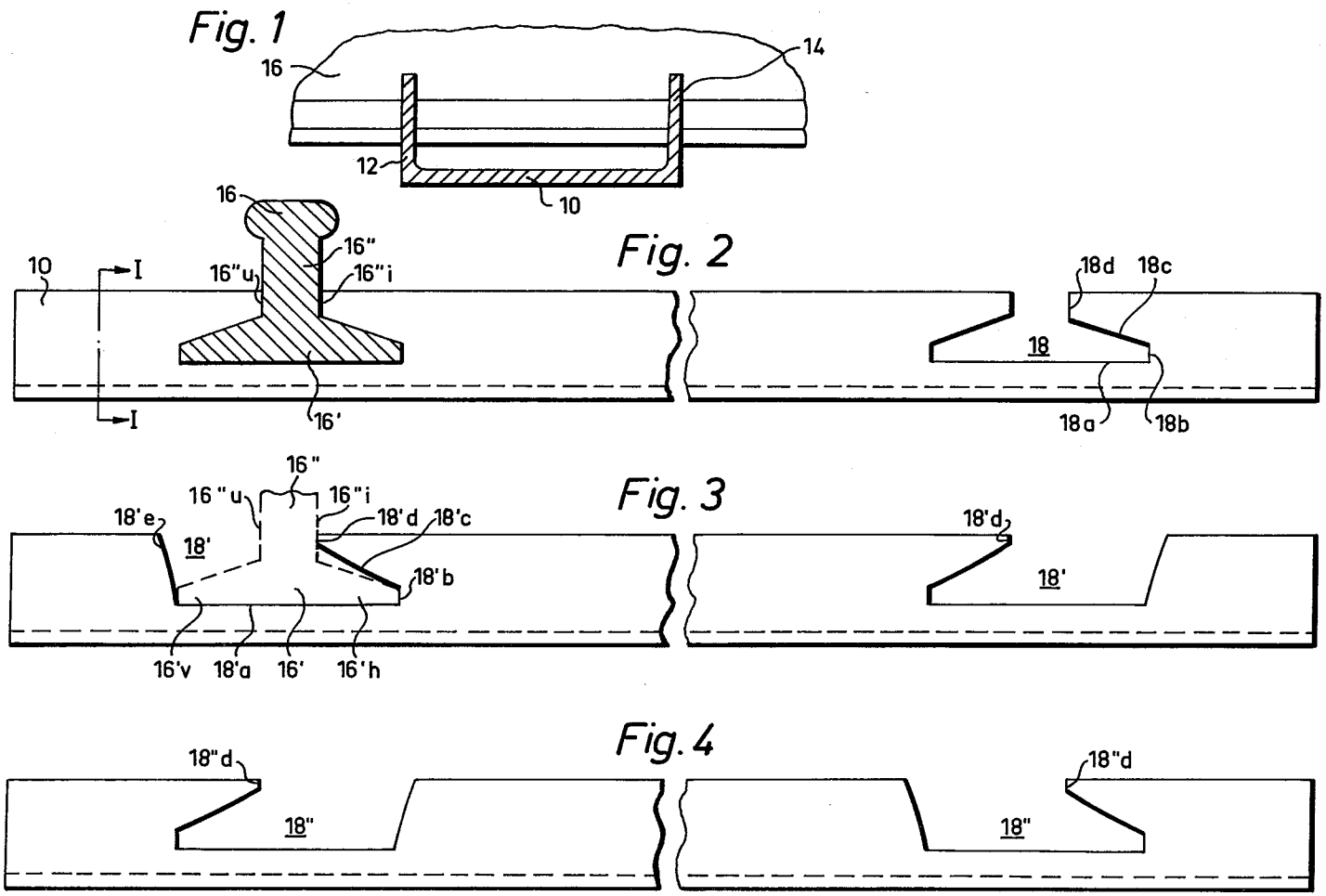
FIG. 1 shows a sleeper with a rail mounted thereon in section along line I—I in FIG. 2.
FIG. 2 shows the two ends of a sleeper with a rail attached thereon and shown in section.
FIG. 3 shows a modification of the sleeper according to FIG. 2 in which the rails during mounting are inserted into a recess in the sleeper.
FIG. 4 shows a modification of the sleeper according to FIG. 3.

All the embodiments of sleepers 10 shown in the drawings are channel iron profiles. However, the invention is not restricted to this material and this specific profile. The web of the sleeper is supported by a bedding (not shown) which may consist of ballast or ballast-free over structure, two flanges 12 and 14 at the cross-sectional ends of the web extending vertically upward. For the purpose of attaching rails 16 at the sleeper the two flanges 12, 14 adjacent the longitudinal ends of the sleeper are provided with two recesses 18 into which the rails are inserted. This sleeper 10 according to FIG. 2 is attached close to both ends of rails 16 by threading one such sleeper each onto either end of rail 16. It is sufficient that each pair of rails is provided with a single sleeper of the type shown in FIG. 2 at either end. The sleeper 10 is provided for this purpose with a recess 18 which is adapted to the lower portion of the profile of the rail 16 comprising the foot 16' and part of the web 16''. The recess 18, accordingly, comprises a bottom portion 18*a*, two lower side portions 18*b*, two inclined portions 18*c* and two upper side portions 18*d*, all these portions after the mounting of the rail abutting against corresponding portions of the rails as clearly appearing from the left portion of FIG. 2.

Between the two end sleepers of the type shown in FIG. 2 of the pair of rails, intermediate sleepers having a recess 18' or 18'' according to FIGS. 3 or 4 are attached, these sleepers permitting rails 16 to be inserted from above into recess 18' or 18'' by causing one of the two wedge-shaped flanges of the foot 16', for example the right-hand flange 16'*h* shown in FIG. 3 to assume during mounting a downwardly inclined position, the flange subsequently being inserted into the right-hand wedge-shaped part of recess 18' as formed by the bottom portion 18'*a*, the lower side portion 18'*b* and an inclined, convex portion 18'*c* which, for the purpose of enabling the rail to be inserted, must have a spacing increasing towards the rail web 16'' from the upper surface of the right-hand flange 16'*h* when the rail has arrived in its position of rest as shown in FIG. 3, which means that the surface 18'*c* of the recess will be convex. In addition, the insertion of the foot 16' means that the opposite wall 18'*e* of the recess 18' must not have any projecting portion 18'*d* abutting against the rail web 16'' but must be removed, in the embodiment shown cut away, to such an extent that the lower most left outward edge of foot 16' can move along wall 18'*e* into its position of rest. Hereby also a wall 18'*e* will obtain a convex shape as illustrated in the drawing. In the embodiment of the sleeper according to FIG. 3 after mounting of the rails the two portions 18'*d* of both recesses 18' will be in contact with the web surfaces 16'' of the rail pair 16, 16 facing the longitudinal center line of the railroad causing the flanges 16'*h* of the foot 16' inwardly facing said center line to be locked in the vertical direction whereas in the embodiment of the sleeper illustrated in FIG. 4 the two portions 18''*d* of the two recesses 18'' abut against the web surfaces 16''*u* of rail pair 16, 16 turned outwardly from said center line, the outwardly directed flanges 16'*v* of foot 16'' being locked in a vertical direction.

Hereby a secure attachment of rail pair 16 to the sleepers of the invention is rendered possible by using in connection with a first pair of rails sleepers as illustrated in FIG. 3 between the end sleepers according to FIG. 2 and in a second pair of rails attached to the first pair using sleepers as illustrated in FIG. 4 between the end sleepers according to FIG. 2.

Figures 5, 6, 7, 8, 9, 10:
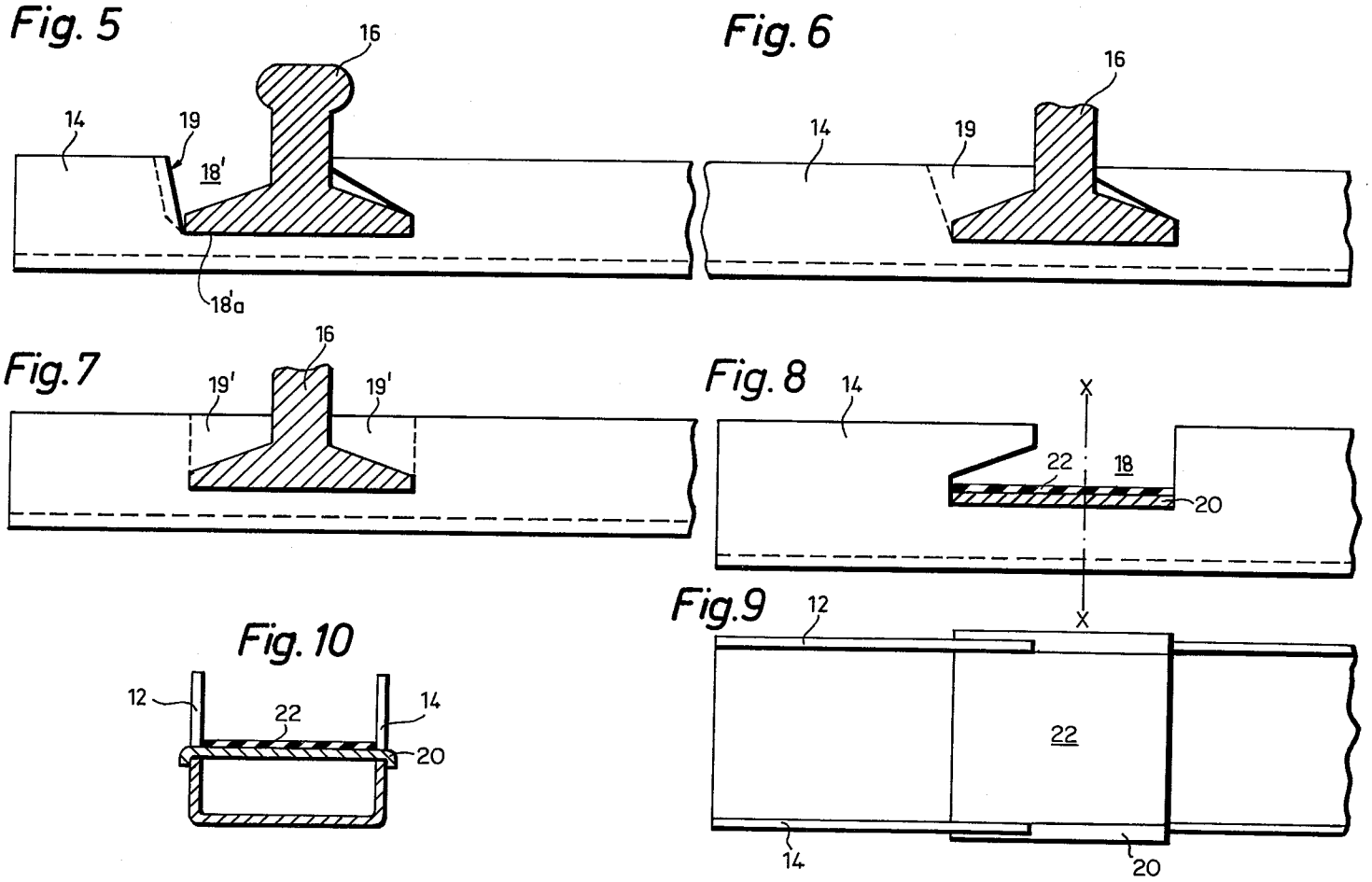
FIG. 5 illustrates a further modification of the sleeper shown in FIG. 3 having a recess which is openable by deflection of a lug, a rail, shown in section, being inserted into the recess.
FIG. 6 shows the sleeper and rail according to FIG. 5 with the recess again closed by bending the lug back to its original position.
FIG. 7 is a view corresponding to FIG. 3 and illustrating a further modification of the sleeper having two lugs adapted to be bent-off and back again.
FIGS. 8 to 10 show in respective elevation, plan view and cross section an embodiment of a sleeper according to the invention including a support plate for the rails.

FIG. 5 illustrates schematically an embodiment of the sleeper which is slightly modified in comparison with the sleeper of FIG. 3 and in which the lug 19 covering the left portion of recess 18', instead of being removed as in FIG. 3 for the purpose of uncovering recess 18', is deflected at right angles or more out of the plane of flange 14 of the sleeper about a line, inclined outwardly from the bottom of the recess thereby enabling the rail to be obliquely inserted as in the embodiments of FIGS. 3 and 4. Preferably the deflection is performed on both flanges 12 and 14 towards the interior of the U-iron 10 forming the sleeper.

After insertion of rails 16 the previously deflected lug 19 may be bent back into its original position as illustrated in FIG. 6. In this way during mounting rail 16 in its entire length insertion into the sleepers may be performed by oblique introduction through the exposed recess, the rail subsequently being secured in its position by bending back at least some of the lugs 19 on the array of sleepers.

FIG. 7 illustrates a further modification of the sleeper according to the invention in which both lugs 19' are deflected prior to the insertion of the rail about a vertical line to completely expose the recess receiving the rail, said lugs after insertion of the rail being bent back into the original position. In the final state illustrated in FIG. 7 with the original position of lugs 19' restored the foot of rail 16 is enclosed throughout between the bottom of the recess and the edges of lug 19'. The advantage obtained by this embodiment resides in the possibility to insert the rail without inclination straight downwardly into the recess and to join the rail rigidly and immovably with the sleeper by a mere mechanical deformation process performed on both lugs 19'. In order to improve the support of the rail on both flanges of the sleeper it may be desirable to insert a support plate 20 into the bottom of the recess in such a way that this plate bridges the interstices between the two flanges 12 and 14. As shown in FIG. 10 the ends of plate 20 are preferably downwardly deflected on the outside of flanges 12 and 14 thereby preventing a lateral shift of plate 20 in relation to flanges 12 and 14. The insertion of plate 20 into the flanges is compatable with each of the embodiments shown in FIGS. 1 to 7. As the provision of plate 20 requires deepening of recess 18, a slight increase of the height of flanges 12 and 14 may be recommendable as indicated in FIGS. 8 and 10.

In place of steel any other material may be used having strength properties corresponding to those of steel, for example newly developed plactics exhibiting high strength at lower weight.

Whereas at present a sleeper having U-profile is preferred, the invention also comprises sleepers formed of other profiles such as I- and T-profiles.

Further modificationf of the above described embodiments according to the invention may be carried out within the basic inventive idea as defined in the attached claims. Hence, for noise eliminating purposes a resilient layer 22, e.g. in the form of a rubber sheet, may be applied on top of the plate 20. Additionally, plate 20 may be provided with downwardly extending lugs on each side of the sleeper flanges 12 and 14, respectively, in order to improve the stability of the structure. If necessary, a ballast may also be provided within the sleeper at the bottom of the U-shaped section, e.g. in the form of concrete, if an ever increased stability is required.

What I claim is:

1. An intermediate sleeper for a pair of railway rails each of said rails comprising a web having a foot which includes first and second flanges extending in opposite directions relative to said web, wherein each said sleeper is one of a plurality of identical sleepers which support said rails at positions spaced inwardly from the ends thereof, each said sleeper comprising a web having at least one upwardly extending flange having a pair of upwardly open recesses therein for receiving one rail each of said pair of rails inserted vertically from above into said respective recess, each of said recesses being partially closed by at least one downwardly convex lug, the spacing between said lug and said first rail flange adjacent thereto increasing towards said rail web, the end of said lug furtherest spaced from said first rail flange contacting said rail web, the spacing between the side of each of said recesses opposing said lug and said rail web increasing away from said rail web, and the end of said second rail flange contacting said opposing side.

2. Sleeper as claimed in claim 1 in the shape of an iron profile having U-shaped cross section, including a support plate which extends in the bottom of the recess between the flanges of the profile.

3. Sleeper as claimed in claim 2 wherein the edges of the plate adjacent said profile flanges are downwardly deflected on the outsides of said profile flanges to secure the plate in position.

4. Sleeper as claimed in claim 2 wherein a resilient layer, e.g. a rubber sheet, is provided on top of the plate for noise eliminating purposes.

5. Sleeper as claimed in claim 1 wherein a ballast, e.g. of concrete, is provided in the sleeper section for strength increasing purposes.

* * * * *